United States Patent [19]

Kruse

[11] 4,037,367

[45] July 26, 1977

[54] GRINDING TOOL

[76] Inventor: James A. Kruse, 22937 Ostronic Drive, Woodland Hills, Calif. 91364

[21] Appl. No.: 643,347

[22] Filed: Dec. 22, 1975

[51] Int. Cl.[2] ..... B24D 7/02

[52] U.S. Cl. ..... 51/209 S; 51/209 R

[58] Field of Search ..... 51/206 R, 206.4, 206.5, 51/209 R, 209 DL, 209 S, 298, 306

[56] References Cited

U.S. PATENT DOCUMENTS

| | | | |
|---|---|---|---|
| 2,820,746 | 1/1958 | Keeleric | 51/209 S X |
| 3,628,292 | 12/1971 | Rue | 51/206 R |
| 3,902,873 | 9/1975 | Hughes | 51/298 |

FOREIGN PATENT DOCUMENTS

| | | | |
|---|---|---|---|
| 364,490 | 12/1921 | Germany | 51/206 R |

*Primary Examiner*—Gary L. Smith

*Attorney, Agent, or Firm*—Emmette R. Holman

[57] ABSTRACT

In a rotary tool adapted for grinding under a flowing liquid film, wherein the particles of abrasive are metal-bonded to a rigid supporting surface, the improvement consists of a network in the supporting surface of grooves having constant depth and constant width and traversing said supporting surface to provide a continuum of centrifugal drainage grooves in the radial direction thereby subdividing said supporting surface into working elements. The ratio of the total area ($A_E$) of said working elements to the total area ($A_G$) of said network of grooves: $A_E/A_G$ is at least 1.5. The configuration of the network of grooves is selected such that the angle of intersection of any side of any channel with the radius at any point is an acute angle between 0° and 75°.

15 Claims, 10 Drawing Figures

GRINDING TOOL

BACKGROUND OF THE INVENTION

This invention relates to an improved rotary tool adapted for grinding under a flowing liquid film wherein the particles of abrasive are metal-bonded to a rigid supporting surface.

In the wet grinding of hard materials such as amethyst and sapphire with metal-bonded abrasive, e. g., diamond particles, it is known that a limiting factor governing the cutting rate is the accumulation and packing of detritus at the roots of the particles of abrasive, filling the intergranular spaces and ultimately burying the abrasive grains. For all practical purposes the cutting action ceases when the abrasive grains are buried in the detritus.

To improve the removal or scavenging of the detritus from the intergranular interstices it was taught, e.g., by G. F. Keeleric in U.S. Pat. No. 2,820,746 issued Jan. 21, 1958, to cluster the abrasive into tiny dots less than 1/4 inch in diameter leaving a major portion of the area unoccupied by abrasive. The density of population of abrasive particles per total working area of the tool was thereby reduced significantly. With this configuration the initial cutting rate was substantially increased. However, under hard grinding conditions, e.g., with a sapphire workpiece, the cutting rate dropped to about half of the initial rate within a relatively short service period.

One of the objects of the invention is to prolong the service life of the grinding tool.

Another object of the invention is to provide more abrasive particles per total area of the tool without necessarily increasing the local density of packing of abrasive particles within the working clusters or elements.

Another object of the invention is to improve the scavenging of detritus from the roots of the particles of abrasive.

Another object of the invention is to improve the quality of grinding and thereby to reduce the conventional number of grinding steps with progressively finer abrasive tools in the sequence prior to final polishing.

DETAILED DESCRIPTION

Figure 1:
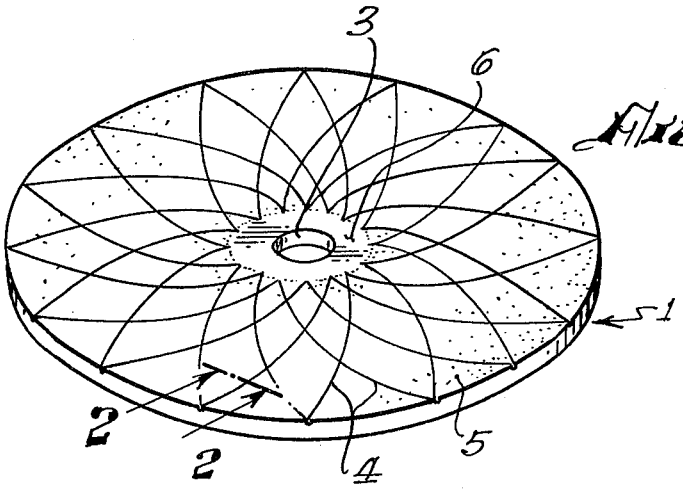
FIG. 1 is a perspective view of a grinding disk of the preferred embodiment with an annular grooved working area.

Referring now to FIG. 1 the circular disk 1 is shown with a central opening 3 adapted for mounting on a vertical rotatable arbor, not shown. A network of grooves 4 traverses an annular portion of the top face of the disk, herein designated as the working area, subdividing the working area into working element surfaces 5 and grooves 4, leaving a central area 6 free of grooves and uncoated with abrasive particles and adapted to engage the washer and nut, not shown, of the arbor on which it is to be mounted.

Figure 2:
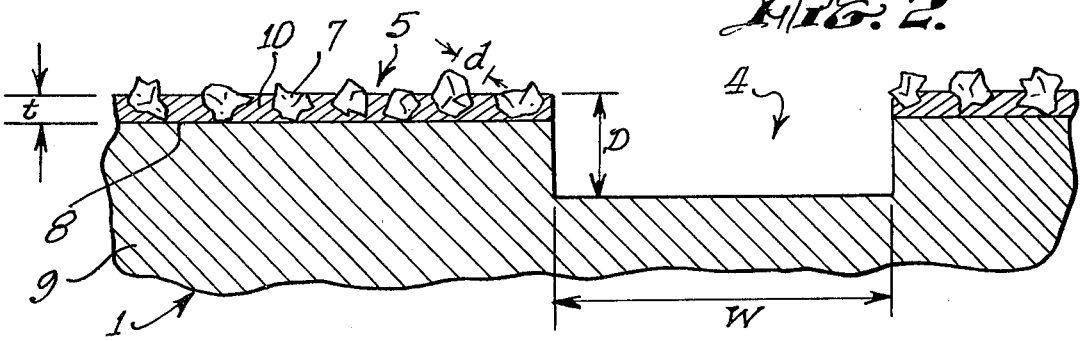
FIG. 2 is a section through 2—2 of FIG. 1 enlarged to show details of the grooves and of the bonding of the abrasive particles in the surface of the working elements.

FIG. 2 is an enlarged sectional view taken along 2—2 of FIG. 1 of disk 1 showing the rectangular cross-section of the groove 4 having a uniform depth D and a uniform width W. The working element surface 5 is studded with particles of abrasive 7 rigidly bonded to the supporting face 8 of the main body 9 of the disk by means of a coating of metal 10 deposited thereover to a thickness $t$ which is greater than one half of the nominal diameter $d$ of the abrasive particles 7 but less than the full diameter, i.e., $d/2<t<d$. A coating of such adequate thickness is seen in FIG. 2 to engage each particle of abrasive at its root at a re-entrant angle, firmly anchoring it in the coating and locking it into position. Each particle is thus rigidly bonded to the supporting surface 8. The strength of this bond depends on several factors, but primarily on the strength of the metal comprising the coating and secondarily on the strength of the material of construction of the body 9 of the disk 1.

The particles of abrasive may be selected from any of the materials commonly used for this purpose, e.g., diamond fragments, silicon carbide, and aluminum oxide products such as emery and corundum and, indeed, softer materials, all of these being well known in the art, but because of the high cost of producing the tool of the present disclosure I prefer to use industrial diamond fragments because this is the hardest abrasive material and outlasts all others, hence becomes cheaper in the long run. The abrasive particle size may range from 50,000 M (0.5 microns) to 20 M (840 microns).

The bonding metal coating 10 may be composed of nickel, cobalt, iron, copper, silver or any laminated combination of these metals or their alloys. Of these I prefer nickel for its reasonable cost and excellent physical strength. The coating 10 may be deposited by any process selected from the group consisting of electroless plating, electroplating, vacuum sputtering, sintering, and any combination of these processes. However, I prefer to use electroplated nickel because of the residual high compressive stresses remaining therein which tend to close the grasp of the coating around the root of each particle of abrasive and, secondarily, increases the hardness of the metal, hence its resistance to wear. The application of these metals are well known in the art. For example, a process for metal bonding of abrasive particles with nickel is the subject of U.S. Pat. No. 2,820,746 issued to G. F. Keeleric on Jan. 21, 1958, and is not the subject of this disclosure.

The body 9 of the disk 1 may be constructed of any rigid material selected from the group consisting of: thermoplastic resin, thermosetting resin, laminated resin, cast iron, steel, aluminum, zinc alloy die casting and copper. Of these I prefer the steel disk because of its superior mechanical strength, good electrical conductivity, reasonable cost, and the relatively simple process for preparing its surface for electroplating with nickel. The alternative materials have inferior mechanical strength and rigidity and the plastic materials have the added disadvantage of requiring extra procedures to render them electroconductive.

Figure 3:
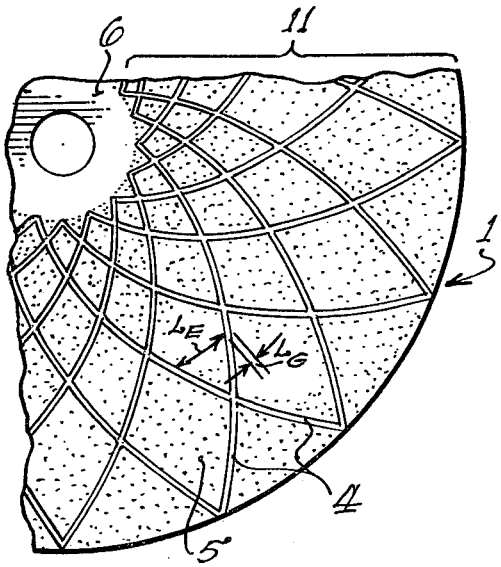
FIG. 3 is a fragmentary quarter sectional plan view of the embodiment of FIG. 1, the remaining three quarters of the disk being of the same configuration.

In FIG. 3 the preferred embodiment pattern of the network of grooves 4 is shown traversing a working area 11 and terminating at the edge of the vacant central area 6. The grooves subdivide the working area 11 into discrete lands or working elements which are predominantly quadrilateral in shape and measure 0.25 to 1.0 inch along any side for the 6 inch size disk illustrated here. For disks of other sizes these dimensions may be scaled up or down in proportion to the size of of the disk that is elected, or, alternately, the illustrated pattern may be trimmed down, or extrapolated outwardly, to the desired size. The pattern of the network of grooves is selected to include the mirror image of the sequence of repeating lines or curves. Therefore the pattern functions equally well regardless of whether the disk rotates clockwise or counter-clockwise. Additionally, I find that the criss-crossing of the grooves seems to improve the scavenging effectiveness and thereby also the cutting rate and quality of grinding.

The curvature of the grooves shown fits the shape of a hypocycloid best, however very close approximations can be made with appropriate segments of other curves to be found in the draftsman's kit, including even the circular arc, without significantly changing the drainage effectiveness of the network.

Figure 4:
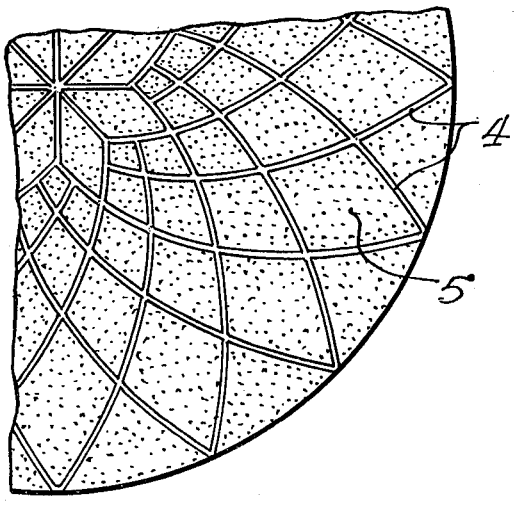
FIG. 4 is a fragmentary quarter sectional plan view of a first alternative embodiment similar to FIGS. 1 and 3, but with the grooved working area covering the entire upper face of the disk instead of an annular portion thereof.

FIG. 4 is a first alternative embodiment identical to FIG. 3 except that the working area occupies the entire top surface of the disk and the vacant central area 6 with central opening 3 is absent. This type of disk may be mounted on the end of a vertical arbor by means of a concentric boss on the under side of the disk threaded to receive the threaded end of the arbor. This type of disk is used for grinding large workpieces, for example, in the lapidary trade for the grinding of book ends, where the arbor nut protruding above the top face of the disk would interfere with the workpiece.

Figure 5:
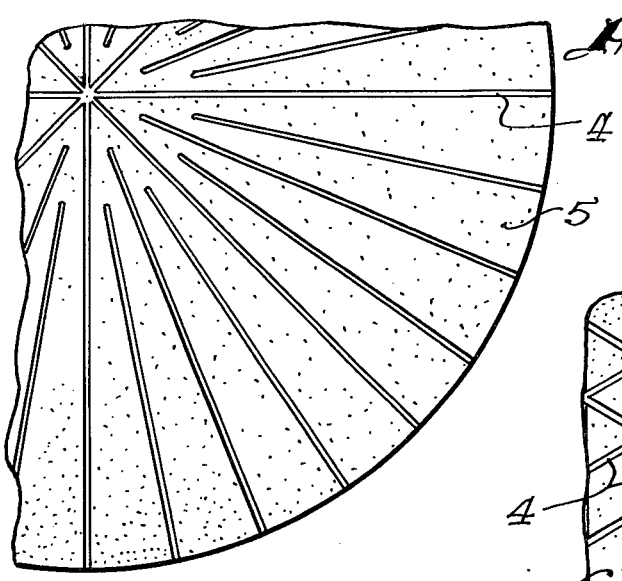
FIG. 5 is a fragmentary quarter sectional plan view of a second alternative embodiment having radial grooves traversing the entire upper face of the disk.

FIG. 5 is a second alternative embodiment illustrating a straight line radial pattern with the working area occupying the entire top face of the disk. This version can be provided with a central arbor opening comparable to that shown in FIG. 3 and it is intended to be included within the scope of this disclosure.

Figure 6:
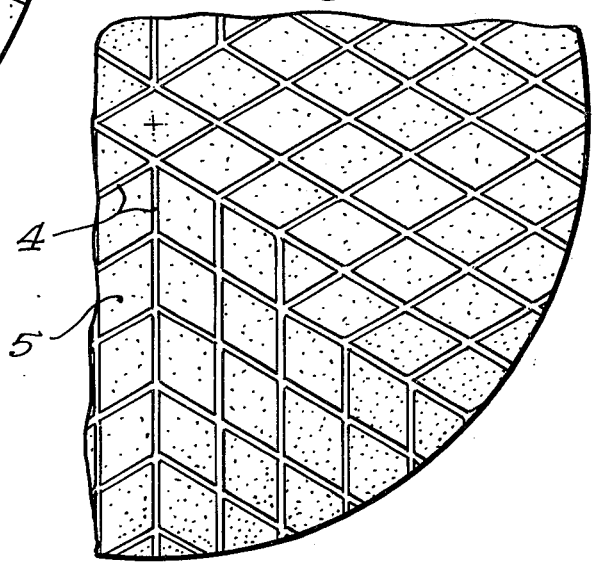
FIG. 6 is a fragmentary quarter sectional plan view of a third alternative embodiment featuring diamond-shaped working elements over the entire upper face of the disk.

FIG. 6 shows a third alternative embodiment derived from a mosaic of identical diamond-shaped working elements. The working area occupies the entire top surface in the embodiment of FIG. 6, but an alternative version having a central arbor opening, not shown, is intended to be included within the scope of this disclosure.

Figure 7:
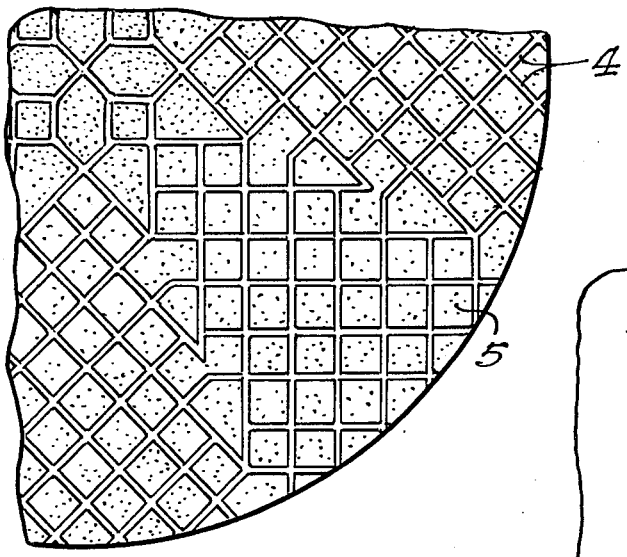
FIG.7 is a fragmentary quarter sectional plan view of a fourth alternative embodiment featuring square-shaped working elements over the entire upper face of the disk.

FIG. 7 shows a fourth alternative embodiment based on a pattern of identical squares covering the entire top face of the disk. The groove sides intersect the radius at acute angles ranging between 22.5° to 68°. An alternative version provided with a central arbor opening, not shown, is intended to be included within the scope of this disclosure.

Figure 8:
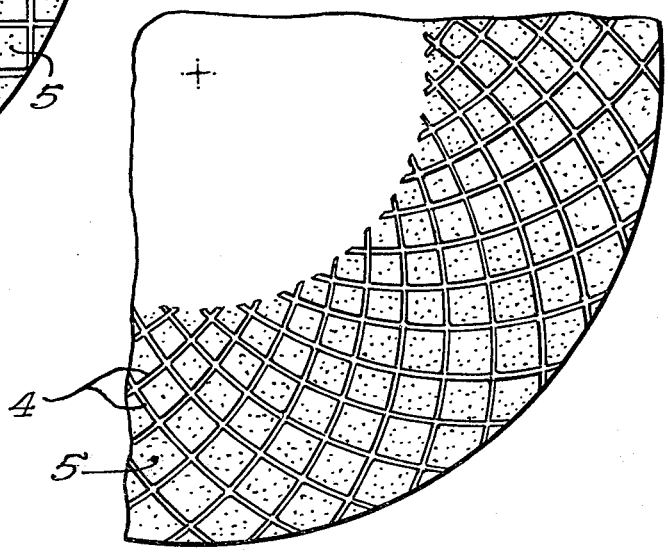
FIG. 8 is a fragmentary quarter sectional plan view of a fifth alternative embodiment featuring a network of grooves generated by a family of circular arcs.

FIG. 8 shows a fifth alternative embodiment based on a family of circular arcs of radius R = radius of the disk, the centers of these circular arcs being taken at uniformly spaced intervals along a circle of radius 0.7 R which is concentric with the disk. On account of the convergence of the grooves toward the center of the disk and ultimately these circular arcs intersecting tangentially a circle of radius 0.3 R concentric with the disk, the working area of this embodiment is confined to an annulus having inner and outer diameters both restricted within the range of 0.6 R and 2.0 R.

Figure 9:
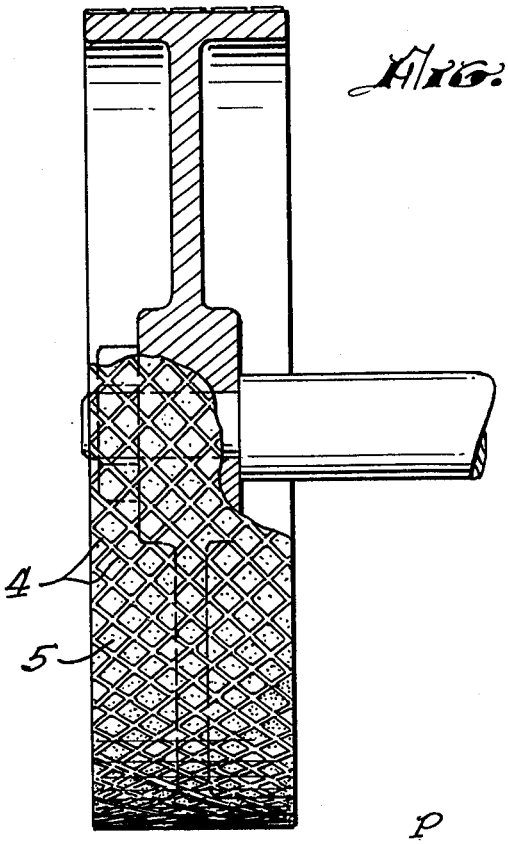
FIG. 9 is an alternative embodiment of the invention as it applies to an edge-cutting grinding wheel, shown here in elevational view partly in section.

FIG. 9 is an alternative embodiment adapting the square configuration of the disk embodiment of FIG. 7 for an edge-cutting grinding wheel. An alternative version, not shown, adapting the diamond pattern of FIG. 6 is intended to be included within the scope of this disclosure. The centrifugal forces acting on the grinding fluid cannot be utilized the same way with an edge-cutting wheel as they are with the disks shown in FIGS. 1 – 8, inclusive. With the edge-cutting wheel one must rely instead on inertial forces to propel the film of grinding fluid laterally instead of radially along the grooves and though the intergranular interstices while momentarily confined by the body of the workpiece pressing against the wheel.

Figure 10:
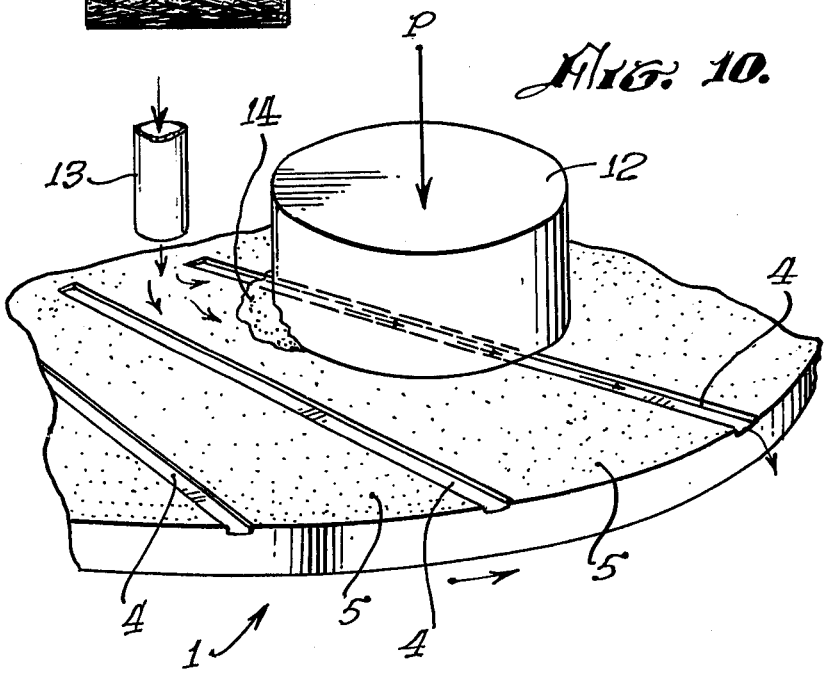
FIG. 10 is an enlarged fragmentary schematic drawing in perspective illustrating the grinding of one end of a cylindrical workpiece on a disk according to the invention.

FIG. 10 illustrates schematically the operation on the radially grooved disk shown in FIG. 5. A workpiece 12 is held in place over the working area of the disk 1 and a vertical force P is applied downwardly upon it. The grinding fluid, water, is introduced near the center of the disk, upstream of the workpiece. A standing wave of water gathers and boils at the base of the workpiece like the foam at the prow of a ship. Within this standing wave is a bank of detritus the individual fragments of which cover a broad range of particle size. The finest particles are readily suspended in the water and are promptly carried away with it. The coarse grains require heavier and faster flows to carry them away. Such flows are provided in the grooves 5 of this disclosure. Failure to properly scavenge the coarse grains of detritus allows them to roll between the workpiece and the grinding tool tending to keep them apart; thereby reducing the cutting rate and quality.

As seen in FIG. 10 the groove which is momentarily under the workpiece 12, may be likened to the channel between two vanes of the impeller of a centrifugal pump. The vanes periodically sweep across the bottom of the workpiece like a squeegee. For the brief instant that the groove is functioning as a miniscule centrifugal pump there is generated therein a sudden pulse of hydraulic pressure and high flow rate capable of carrying away the coarsest particles of detritus.

The minimum depth and width of the groove accordingly, depend on the nominal diameter $d$ of the abrasive particles of the grinding tool, whereas the dimensions of the working elements depend largely on the size of the workpiece. I have found that the minimum depth D of the groove should be at least twice the nominal diameter $d$ of the particles of abrasive and that the minimum width W of the groove should be at least 10 times the nominal diameter, i.e., $D \not< 2d$ and $W \not< 10d$. However, the grooves must not be excessively wide, since small workpieces bounce and become difficult to hold steady as they traverse wide grooves.

For most purposes I find satisfactory a groove depth broadly within the range of 0.00004 inch (1 micron) to 0.1 inch (2540 microns), preferably 0.00004 inch (1 micron) to 0.06 inch (1524 microns), and a groove width broadly within the range of 0.0002 inch (5 microns) to 0.15 inch (3810 microns), preferably 0.001 inch (25 microns) to 0.08 inch (2032 microns).

The preferred and alternative embodiments of this disclosure have in common a pattern of the network of grooves each providing a continuum of centrifugal drainage grooves in the radial direction subdividing the supporting surface into working elements which are predominantly quadrilateral in shape. At any point in the working area the groove intersects the radius at an acute angle within the range of 0° to 75°.

A number of 6 inch diameter grinding disks were prepared to investigate the effect of grooves in the working surface versus no grooves and also in various patterns of groove networks. All tests were run under constant conditions standardized as follows:

Arbor vertical, 800 rpm, rotation counter-clockwise
Nominal diameter of abrasive particles $d$ = 80 microns(180 M)
Workpiece A: end of 1 inch diameter cylinder of amethyst
Workpiece B: end of 1 inch diameter cylinder of synthetic sapphire
Vertical loading of workpiece: 5 lbs.
Testing area: 0.25 inch inward from outer edge of disk Before actual testing each disk was "run in" using the following procedure: 40 minutes with Workpiece A followed by 10 minutes with Workpiece B.

The actual test consisted of measuring the cumulative weight loss of Workpiece A after five grinding cycles of 2 minutes each, i.e., after a total of 10 minutes of grinding. The test results are shown in Table I.

TABLE I

| Disk | Wt. Loss (gms.) | $A_E/A_G$ | $L_E/L_G$ | $\Theta_{max}$ |
|---|---|---|---|---|
| Plain, no grooves | 0.28 | ∞ | ∞ | ** |
| FIG. 3 | 0.85 | 9.18 | 9.27 | 56° |
| FIG. 5 | 0.52 | 10.66 | 9.27 | 0° |
| FIG. 6 | 0.60 | 4.23 | 6.77 | 68° |
| FIG. 7 | 0.62 | 4.08 | 6.77 | 68° |
| FIG. 8 | 0.45 | 3.02 | 4.19 | 50° |
| Dot pattern* | 0.55 | 0.14 | 0.2 | ** |

*U.S. Pat. No. 2,820,746 issued to G. F. Keeleric on Jan. 21, 1958
**Not applicable The above results show that the grinding rate on amethyst for the preferred embodiment of FIG. 3 was 0.85/0.28 = 3 times that of the plain disk which had no grooves, while the alternative embodiments were about twice as fast. The dot pattern gave initially high grinding rates comparable to the FIG. 3 configuration, but only when applied exclusively to the relatively soft mineral: amethyst. However, after applying to the much harder synthetic sapphire for only 10 minutes, the rate for the dot pattern dropped 30% versus 2% for the FIG. 3 pattern.

The dot pattern disk was still on a rapidly decreasing part of its service life curve while the disks of the present disclosure were showing inconclusive signs of wear. The rapid deterioration of the dot pattern appears to follow simply from the fact that the total population of diamond particles in the working area is considerably less than that of the configurations disclosed herein. With the same loading on the same workpiece on fewer diamond points, each diamond must cut deeper into the workpiece and consequently the stresses on the individual diamond grains are much greater. The wear rate and the tendency for actual fracture or uprooting of the diamonds in the leading edge of each tiny dot cluster is much greater than with the configurations disclosed herein.

One criterion for the service life, accordingly, would be the percent of the working suface that is populated with abrasive particles, assuming that the density is the same in all populated areas. A more sensitive criterion is the ratio $A_E/A_G$ of the total area $A_E$ of the working elements to the area $A_G$ of the network of grooves. The values of $A_E/A_G$ appear in Table I, where it is shown that a minimum ratio of 1.5 effectively distinguishes the groove network patterns of this disclosure from the dot pattern of U.S. Pat. No. 2,820,746.

Another criterion is the ratio $L_E/L_G$ obtained by scribing a circle at mid-radius of the working area of the disk, e.g., on a 6 inch disk at radius 1.78 inches, and then measuring the cumulative lengths of arc $L_E$ traversing the working elements and the cumulative lengths of arc $L_G$ traversing the grooves. The values of $L_E/L_G$ appear in Table I, where it is shown that a minimum ratio of 1.5 effectively distinguishes the groove network patterns of this disclosure from the dot pattern of U.S. Pat. No. 2,820,746.

For good scavenging of the detritus the grooves must not be inclined too steeply to the radius at any point since they are useless when inclined at right angles to the radius. Designating $\theta$ as the acute angle at the intersection of a channel with the radius and $\theta_{max}$ as the highest value of $\theta$ for the whole pattern of a given network, $\theta_{max}$ is an important criterion for distinguishing network patterns. The values of $\theta_{max}$ are listed in Table I, where it can be seen that all values for network patterns of this disclosure lie within the range of $\theta = 0°$ to 75°.

With improved scavenging of the detritus it follows that the quality of the cutting action and the surface finish are likewise improved. Although the procedure varies widely between lapidary artisans the following schedule is singled out as an example:

The workpiece is subjected to grinding with progressively finer abrasive grain sizes in the following sequence using metal-bonded abrasive disks, a. without grooves:
100M - 260M - 600M - 1200M - 8000M - then polish* b. with groove network pattern according to FIG. 3:
260M - 1200M - 8000M - then polish*

* 50000M diamond imbedded in plastic or soft metal

Thus 5 grinding steps are reduced to 3 without impairing the quality of work. The need to carry the 100M and 600M disks in inventory is eliminated, which is a substantial saving for the small artisan.

I claim:

1. A rotary grinding disk adapted for grinding under a flowing liquid film having a flat top supporting surface to which particles of abrasive are rigidly bonded and a network of grooves of constant depth and width traversing said supporting surface to provide a continuum of centrifugal drainage channels in the radial direction and subdividing said supporting surface into working elements of quadrilateral shape at least 0.25 inch in length on each side, said sides being inclined to the radius at an acute angle of 0° to 75° measured in either sense, wherein a family of concentric circles each trace circular arcs partly across said working elements of arc length $L_E$, and partly across said grooves of arc length $L_G$ and wherein the ratio of arc length $L_E/L_G$ is at least 1.5, said grooves being substantially rectangular in cross-section, having a depth of 0.00004 inch (1 micron) to 0.1 inch (2540 microns), and a width of 0.0002 inch (5 microns) to 0.15 inch (3810 microns).

2. A rotary grinding disk according to claim 1 wherein said particles of abrasive range in size from nominal diameters of 0.5 microns to 840 microns.

3. A rotary grinding disk according to claim 2 wherein said particles of abrasive are bonded to said surface by metal deposited upon said supporting surface after the particles of abrasive have been distributed over the working elements thereof, and continuing the metal deposition process until a coating thickness sufficient to rigidly bond the particles of abrasive has been achieved.

4. A rotary grinding disk according to claim 3 wherein said coating thickness of bonding metal is sufficient to partially submerge said particles within the coating to provide a re-entrant angle of contact about said particles thereby to rigidly anchor the particles to the supporting surface.

5. A rotary grinding disk according to claim 3 wherein said coating thickness of bonding metal is greater than one-half of the nominal diameter of the particles distributed over the working elements thereof but less than the full nominal diameter of the particles.

6. A rotary grinding disk according to claim 1 wherein said supporting surface is composed of a structural material selected from the group consisting of thermoplastic resin, thermosetting resin, laminated resin, cast iron, steel, aluminum, zinc alloy die casting, and copper.

7. A rotary grinding disk according to claim 4 wherein said coating of bonding metal is formed by a process selected from the group consisting of electroless plating, electroplating, vacuum sputtering, and sintering.

8. A rotary grinding disk according to claim 3 wherein said particles of abrasive are diamond ranging in size from nominal diameters of 0.5 microns to 840 microns imbedded in a matrix of nickel bonded to said supporting surface, said matrix of nickel having a total thickness greater than 0.5 times the nominal diameter but less than the full nominal diameter of said particles of abrasive, and said supporting surface is composed of steel.

9. A rotary grinding disk according to claim 8 wherein said grooves have a depth of 0.00004 inch (1 micron) to 0.06 inch (1524 microns), and a width of 0.0002 inch (5 microns) to 0.08 inch (2032 microns).

10. A rotary grinding disk according to claim 2 said working elements of which cover a total area $A_E$, said grooves of which cover a total area $A_G$, wherein the ratio of $A_E/A_G$ is at least 1.5.

11. A rotary grinding disk according to claim 2 wherein said grooves have a depth at least 2 times said nominal diameter and a width of at least 10 times said nominal diameter of the particles.

12. A rotary grinding disk according to claim 10 wherein said grooves have a depth of at least 2 times said nominal diameter and a width of at least 10 times said nominal diameter of the particles.

13. A rotary grinding disk according to claim 12 wherein said grooves have a width of at least 20 times said nominal diameter of the particles.

14. A rotary grinding disk according to claim 12 wherein said grooves have a width of at least 20 times said nominal diameter of the particles.

15. An edge-grinding wheel according to claim 14 wherein said supporting surface is cylindrical, said network of grooves traverse said cylindrical supporting surface to provide a continuum of grooves draining laterally and subdivides said cylindrical supporting surface into working elements.

* * * * *

UNITED STATES PATENT OFFICE

CERTIFICATE OF CORRECTION

Patent No. 4,037,367 Dated July 26, 1977

Inventor(s) James A. Kruse

It is certified that error appears in the above-identified patent and that said Letters Patent are hereby corrected as shown below:

In claim 13, "12" should read --11--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*